US006053713A

United States Patent [19]

Brown

[11] Patent Number: 6,053,713

[45] Date of Patent: Apr. 25, 2000

[54] GAS COMPRESSORS

[75] Inventor: Gary Peter Brown, Bristol, United Kingdom

[73] Assignee: Knorr-Bremse Systems for Commercial Vehicles Limited, United Kingdom

[21] Appl. No.: 09/119,600

[22] Filed: Jul. 22, 1998

[30] Foreign Application Priority Data

Jul. 26, 1997 [GB] United Kingdom ..... 9715741

[51] Int. Cl.[7] ..... F04B 39/10

[52] U.S. Cl. ..... 417/571; 417/569

[58] Field of Search ..... 417/571, 569, 417/269; 137/856, 857; 92/144; 165/185

[56] References Cited

U.S. PATENT DOCUMENTS

| | | |
|---|---|---|
| 2,043,849 | 6/1936 | Bixler . |
| 2,151,746 | 3/1939 | Cody . |
| 2,852,184 | 9/1958 | Stolte . |
| 3,986,798 | 10/1976 | Lindell et al. . |
| 4,193,424 | 3/1980 | Hrabal . |
| 5,265,646 | 11/1993 | Richardson . |
| 5,266,016 | 11/1993 | Kandpal . |
| 5,454,397 | 10/1995 | Miszczak . |
| 5,456,287 | 10/1995 | Leu . |
| 5,558,508 | 9/1996 | Sesano et al. . |
| 5,603,611 | 2/1997 | Tarutani et al. . |
| 5,860,800 | 1/1999 | Kramer et al. . |

FOREIGN PATENT DOCUMENTS

| | | |
|---|---|---|
| 372 154 B1 | 6/1990 | European Pat. Off. . |
| 494590A1 | 7/1992 | European Pat. Off. . |
| 571 715 A1 | 12/1993 | European Pat. Off. . |
| 705 977 A1 | 6/1996 | European Pat. Off. . |
| 7200686 | of 0000 | Germany . |
| 1 129 784 | 5/1962 | Germany . |
| 1142478 | 1/1963 | Germany . |
| 6946784 | 11/1969 | Germany . |
| 1957668 | 5/1971 | Germany . |
| 2410705 | 9/1975 | Germany . |
| 2733089 | 2/1979 | Germany . |
| 3305791 A1 | 8/1984 | Germany . |
| 3813539C2 | 11/1988 | Germany . |
| 3909531A1 | 6/1990 | Germany . |
| 3940099A1 | 6/1991 | Germany . |
| 4125123A1 | 2/1992 | Germany . |
| 19535079 | 4/1996 | Germany . |
| 59-208181 | 11/1984 | Japan . |
| 992232 | 3/1962 | United Kingdom . |
| 1132506 | 11/1968 | United Kingdom . |
| 1409589 | 10/1975 | United Kingdom . |
| 2018364 | 10/1979 | United Kingdom . |
| 2044365 | 10/1980 | United Kingdom . |
| 2083566 | 3/1982 | United Kingdom . |
| 2 165 317 | 4/1986 | United Kingdom . |
| 2171465 | 8/1986 | United Kingdom . |
| 2208 180 | 3/1989 | United Kingdom . |
| 2319569 | 5/1998 | United Kingdom . |

*Primary Examiner*—Mark Paschall
*Assistant Examiner*—Vinod D Patel
*Attorney, Agent, or Firm*—Barnes & Thornburg

[57] ABSTRACT

A piston and cylinder air compressor has a valve plate between an upper end of the cylinder and a cylinder head, the valve plate having a generally diametrically located recess at the inward surface thereof accommodating a suction valve reed, the valves being located above apertures at least to one side of said recess the arrangement being such as to minimize the operating clearance volume of the compressor.

11 Claims, 2 Drawing Sheets

GAS COMPRESSORS

BACK AND SUMMARY OF THE INVENTION

This invention relates to gas compressors and relates more especially to a cyclically operating compressors which has a reed-valve via which gas is drawn during induction strokes.

In compressed air systems installed on commercial vehicles it is well known to provide a cyclically operable air compressor driven by an electric motor or the vehicle internal combustion engine, to supply compressed air to charge one or more reservoirs. Such reservoirs provide sources of compressed air for pneumatic braking systems and auxiliary equipment of the vehicle. During the past two decades the efficiency of such compressors has been enhanced by the use of reed-valves instead of poppet valves for inlet and delivery.

Air compressors employing reed valves have been described in prior-published Patent Specifications such as for example U.K. Patent Specifications Numbers 2165317 and 2208180 and European Patent Specification Number 0 372 154. In such a compressor air is drawn into a working cylinder of the compressor via a plurality of air induction apertures of a valve plate covered by a flexible inlet reed on the inward surface of a valve plate and is deflectable by pressure depressions in the compression chamber. Such air induction apertures are typically provided around a circular perimeter arc, air delivery passages being located generally more centrally and covered by a delivery reed on the outward surface of the valve plate.

Such compressors have been found to be subject to the limitations of the possible rate of the delivery of compressed air. In particular it has become realised that compressor performance has been adversely constrained by the clearance volume of a compressor and the object of the present invention is to provide a gas compressor with improved performance.

According to the present invention there is provided a gas compressor having a compression chamber with a cyclically moveable wall which varies the volume of the chamber between a maximum induced gas volume and a minimum compressed gas clearance volume and having a valve plate, a gas delivery path through the valve plate and a flexible delivery reed on the outward surface of the valve plate relative to the chamber and a gas induction path with a generally flexible suction reed housed in a recess provided at the inward surface of said valve plate.

Preferably the compressor is a piston and cylinder compressor and said suction reed is supported at one end between said valve plate and the cylinder to cover a plurality of suction apertures generally aligned with a diametral plane of the cylinder.

Said valve plate may have an unloader valve cooperating with said outward surface of the valve plate and a passage passing through the valve plate and said suction reed.

Said valve plate may additionally carry a further flexible delivery reeds on its outward surface positioned one either side of the induction aperture or apertures.

In order that the invention may be more clearly understood and readily carried into effect the invention will be further described by way of example with reference to the accompanying drawings of.

DESCRIPTION OF THE PREFERRED EMBODIMENTS

Figure 1:
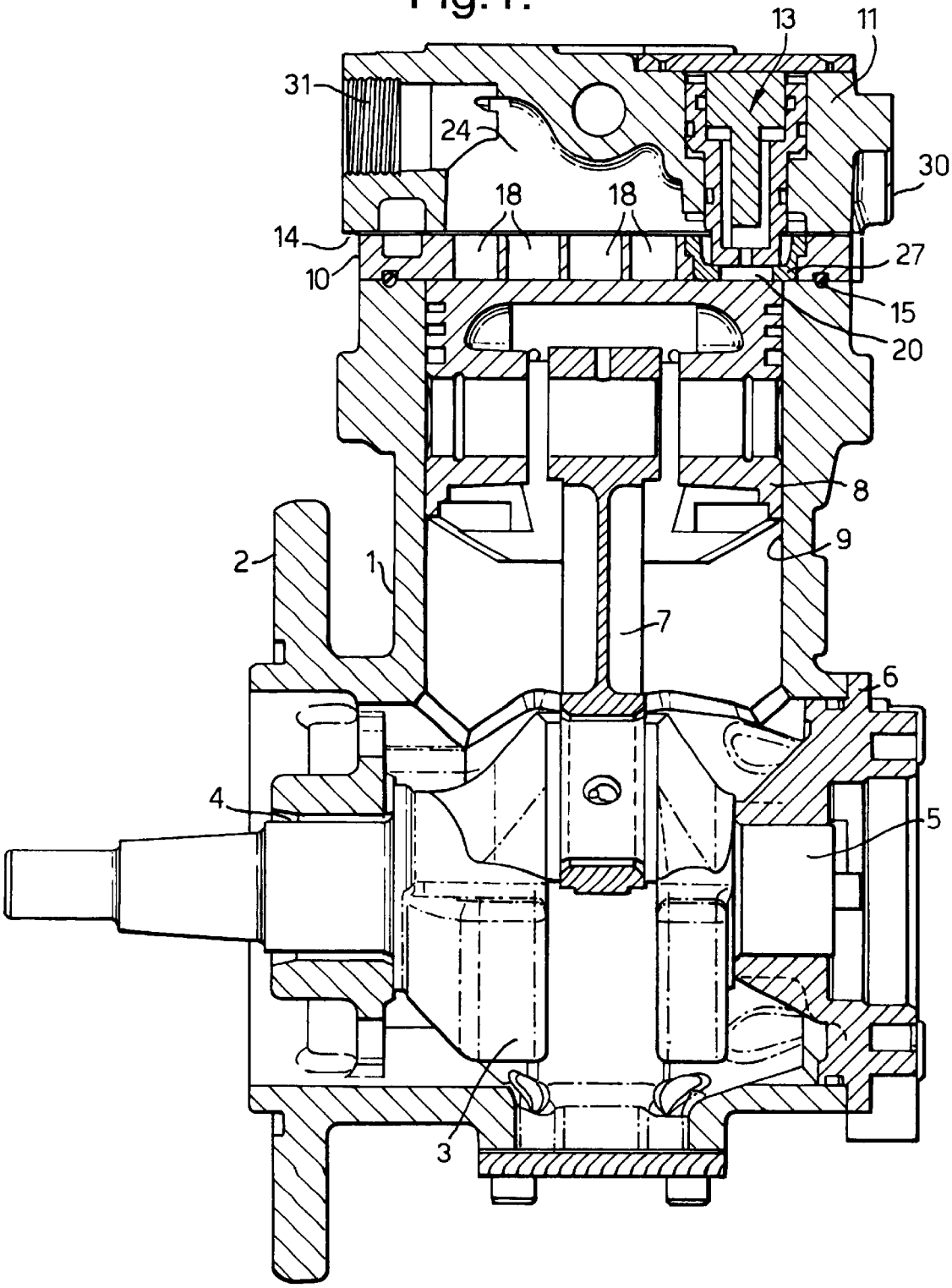
FIG. 1, illustrates a part sectional view of a single cylinder piston compressor of a type intended for use in the compressed air braking system of a heavy commercial vehicle
Figure 2:
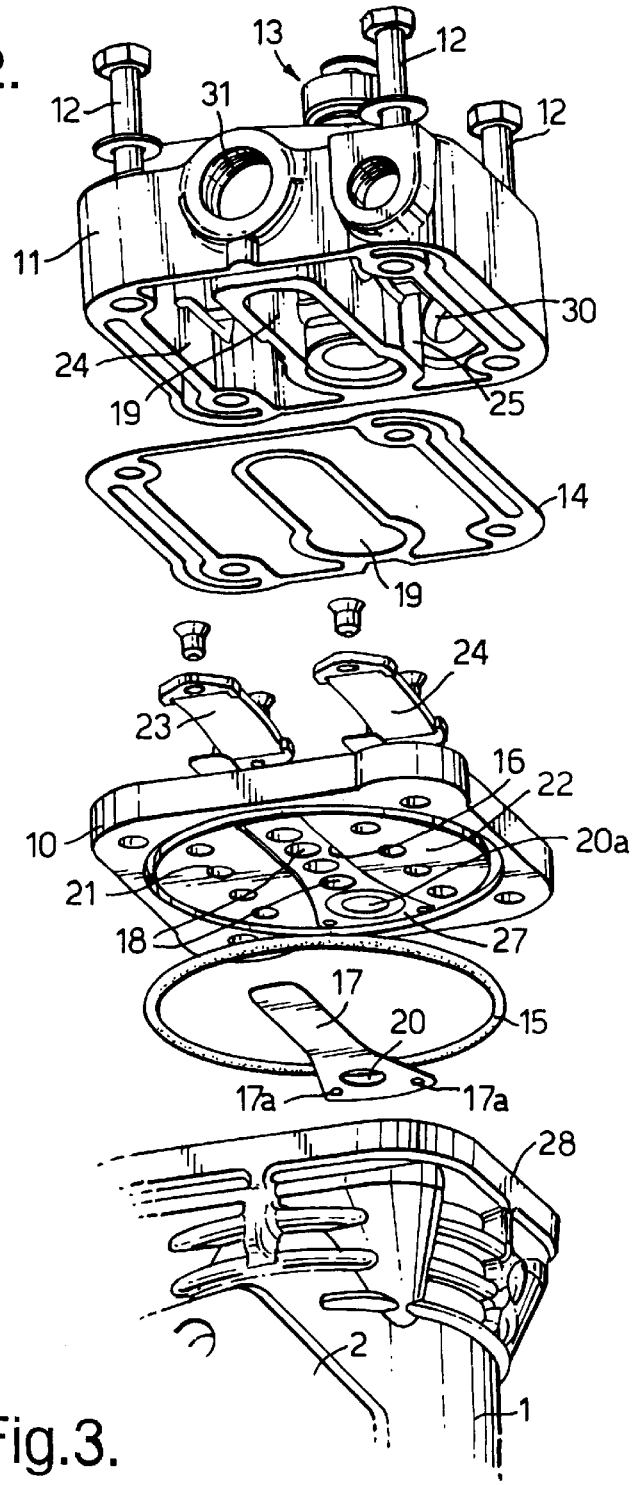
FIG. 2, illustrates an exploded view of the upper part of the compressor of FIG. 1 and FIG. 3, illustrates an alternative construction of the suction reed.

Referring to FIGS. 1 and 2, the compressor comprises a combined cast cylinder, crankcase 1 and mounting flange 2 at the drive end. A crank-shaft 3 is rotatably carried in two bearings 4 and 5, bearing 4 being carried in the drive end of the crank case and bearing 5 being carried in a closure plate 6 which is removable to give access for assembly and servicing. The crank-shaft 3 is conventionally connected via a connecting member 7 to a piston 8 for reciprocating piston movement in the cylinder bore 9. A valve plate 10 is secured by bolts 12 between the upper annular planar end of the cylinder together with a cylinder head 11 which houses inlet and delivery chambers and a pneumatically operable unloader valve assembly 13 as described in the Specification of European Patent No. 0240278. A gasket 14 is provided between the cylinder head 11 and the upper surface of the valve plate 10 whereas an air-tight seal between the under-side of the valve plate 10 and the cylinder is provided by a recessed 'O' ring 15 preferably of elastomer material known by a trade-mark 'VITON' offering good thermal stability.

As seen more especially in FIG. 2, in addition to being provided with an annular recess to accommodate the 'O' ring 15, the under-side of the valve plate 10 is provided with a generally diametral but shaped recess 16 of functionally sufficient depth and periphery in the inward surface as to accommodate a downwardly deflectable suction valve reed 17. Reed 17 has one relatively wider end which is closely retained between the valve plate and the upper end of the cylinder by hard metal locating pins (not shown) engaging apertures 17*a*. The valve reed 17 covers a row of diametrally aligned apertures 18 communicating with an inlet chamber 19 of the cylinder head communicating having an inlet port 31. The valve reed 17 is also provided with a further aperture 20 which communicates with the unloader valve 13 via a passage 20*a* in the valve plate.

The valve plate 10 is further provided with two rows of delivery apertures 21 and 22 one row on each side of apertures 18 and above which on its outward surface respective delivery reed valves 23 and 24 are accommodated in interconnected air delivery chambers 24 and 25 of the cylinder head the latter having a delivery port 30.

Since the suction valve reed 17 is recessed within an otherwise plane underside surface of the valve plate 10 just sufficiently to accommodate the reed, the clearance volume, that is the compressed volume of air above the piston 8 in the top-most position thereof, is minimised subject only to operating tolerances and relevant air path clearances around the periphery of the valve reed 17. One other air passage is the passage 20/20*a* and in the present example the volume of this passage can be limited by providing it in a tight fitting insert 27 in the valve plate to present a recessed seat for the unloader valve, so leaving only minimal volume beneath it when the unloader valve is closed.

In an alternative manner of providing the required recess within which the suction reed is housed at the inward surface of the valve plate of a compressor according to the invention, a gasket which provides sealing between the underside of the valve plate and the compressor cylinder may be appropriately shaped to occupy free space (dead volume space) around the suction reed. In that case the suction reed may be mounted to act against the surface of the valve plate itself in the recess left in the gasket formed.

Figure 3:
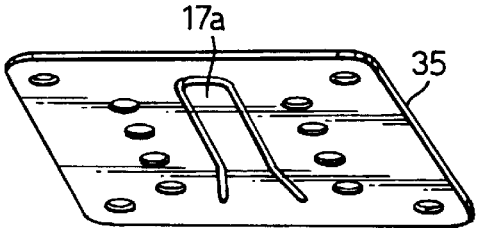

In another alternative manner of providing the required recess at said inward surface of the valve plate the suction reed 17*a* can be manufactured integrally with and joined only at one end of a plate member 35 as illustrated in FIG. 3, which is mounted between the valve plate and the cylinder.

Means to additionally minimise the contribution of an unloader valve in a gas compressor are further described for example in the Specification of Published United Kingdom Patent Specification Number 2319569. It may be observed moreover that whilst the minimum thickness of a relatively soft cast metal valve plate such as 10 may be dictated by the possible distortion thereof which may occur with high pressure fluctuations across it, the insert 27 is of relatively harder metal and the thickness in way of its valve seat may be appreciably less than that of the valve plate. The contribution of the volume in the region of aperture 20 can thereby be minimised.

The use of a recessed 'O' ring 15 in a compressor as described in the foregoing is advantageous because it permits the valve plate to be drawn into face-to-face contact with a flat upper peripheral surface 28 of the cylinder by bolts 12 and there is appreciably reduced risk during assembly or on subsequent servicing of introducing distortion or extra clearance volume due to gasket thickness considerations.

What is claimed is:

1. A gas compressor having a compression chamber with a cyclically movable wall which varies the volume of the chamber between a maximum induced gas volume and a minimum compressed gas clearance volume and having a valve plate, a gas delivery path through the valve plate and a flexible delivery reed on the outward surface of the valve plate relative to the chamber and a gas induction path with a generally flexible suction reed housed in a recess provided at the inward surface of said valve plate.

2. A gas compressor as claimed in claim 1, wherein said suction reed is housed in a recess within said inward surface of said valve plate.

3. A gas compressor as claimed in claim 2, having a piston and a cylinder and wherein said suction reed is supported at one end between the valve plate and a cylinder head to cover a plurality of suction apertures generally aligned with a diametral plane of the cylinder.

4. A gas compressor as claimed in claim 2, having an unloader valve cooperating with said outward surface of the valve plate and having a pressure relief passage passing through said valve plate and through said suction reed.

5. A gas compressor as claimed in claim 1 including a gasket between the valve plate and the cylinder, said gasket being shaped to provide a said recess at the inward surface of the valve plate.

6. A gas compressor as claimed in claim 5, having a piston and a cylinder and wherein said suction reed is supported at one end between the valve plate and a cylinder head to cover a plurality of suction apertures generally aligned with a diametral plane of the cylinder.

7. A gas compressor as claimed in claim 5, having an unloader valve cooperating with said outward surface of the valve plate and having a pressure relief passage passing through said valve plate and through said suction reed.

8. A gas compressor as claimed in claim 1 wherein said suction reed is an integral but movable part of a plate member clamped between said chamber and the valve plate whereby said plate member itself provides said recess at said inward surface.

9. A gas compressor as claimed in claim 8, having an unloader valve cooperating with said outward surface of the valve plate and having a pressure relief passage passing through said valve plate and through said suction reed.

10. A gas compressor as claimed in claim 1, having a piston and a cylinder and wherein said suction reed is supported at one end between the valve plate and a cylinder head to cover a plurality of suction apertures generally aligned with a diametral plane of the cylinder.

11. A gas compressor as claimed in claim 1, having an unloader valve cooperating with said outward surface of the valve plate and having a pressure relief passage passing through said valve plate and through said suction reed.

* * * * *